US007756462B2

(12) United States Patent
Iwasaki et al.

(10) Patent No.: US 7,756,462 B2
(45) **Date of Patent: *Jul. 13, 2010**

(54) IMAGE FORMING APPARATUS AND CLEANING DEVICE

(75) Inventors: Jin Iwasaki, Kanagawa (JP); Makoto Sakanobe, Kanagawa (JP); Yoshitaka Kuroda, Kanagawa (JP); Kanji Shintaku, Kanagawa (JP); Satoshi Shigezaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 71 days.

This patent is subject to a terminal disclaimer.

(21) Appl. No.: 11/711,773

(22) Filed: Feb. 28, 2007

(65) Prior Publication Data

US 2007/0292178 A1 Dec. 20, 2007

(30) Foreign Application Priority Data

Jun. 20, 2006 (JP) ..... 2006-170185

(51) Int. Cl.
*G03G 21/00* (2006.01)

(52) U.S. Cl. ..... 399/357; 399/34; 399/353; 399/354

(58) Field of Classification Search ..... 399/34, 399/71, 343, 353, 354, 357; 430/325, 331
See application file for complete search history.

(56) References Cited

U.S. PATENT DOCUMENTS 5,689,791 A * 11/1997 Swift ..... 399/353
5,802,440 A * 9/1998 Maeyama ..... 430/45.5
5,878,312 A * 3/1999 Hisada ..... 399/149
2003/0104317 A1* 6/2003 Yoshida et al. ..... 430/302
2004/0265007 A1* 12/2004 Hara ..... 399/176
2005/0019071 A1* 1/2005 Akagi et al. ..... 399/356
2005/0089788 A1* 4/2005 Nukada et al. ..... 430/125
2005/0241092 A1* 11/2005 Takesawa et al. ..... 15/179
2006/0083531 A1* 4/2006 Shida ..... 399/71

FOREIGN PATENT DOCUMENTS

JP A-62-67578 3/1987
JP A-1-273083 10/1989
JP A-4-238383 8/1992
JP A-2001-5360 1/2001
JP A-2002-116592 4/2002

* cited by examiner

*Primary Examiner*—David M Gray
*Assistant Examiner*—G.M. Hyder
(74) *Attorney, Agent, or Firm*—Morgan, Lewis & Bockius LLP

(57) ABSTRACT

An image forming apparatus includes: an image carrier that carries an image; a developing unit that develops the image on the image carrier into a toner image; a transfer unit that transfers the toner image carried on the image carrier onto a transfer medium; and a cleaning unit that cleans residual toner, having not been transferred by the transfer unit, from the image carrier. The cleaning unit includes a cleaning roller member provided in contact with the image carrier and supplied with a predetermined bias voltage, having a surface layer of a conductive fiber cloth, and a conductive roller member provided in contact with the cleaning roller member and supplied with a predetermined bias voltage.

15 Claims, 13 Drawing Sheets

FIG. 7

| | | COLLECTION EFFICIENCY (%) | |
|---|---|---|---|
| | | NEW PRODUCT (INITIAL STAGE) | AFTER 50 kPV |
| CLEANING ROLLER (PRESENT INVENTION) | + COLLECTION ROLLER + SCRAPER | 92 | 89 |
| BRUSH ROLLER | | 70 | 65 |
| FOAMED ROLLER | | 75 | 55 |
| RUBBER ROLLER | | 95 | 55 |
| CLEANING ROLLER | + SWEEPER | 60 | 48 |

FIG. 10

| EXECUTION/ NONEXECUTION OF CORONA EFFLUENCE ELIMINATION MODE | | CORONA EFFLUENCE ELIMINATION MODE EXECUTION TIME | | |
|---|---|---|---|---|
| | | 2 MINUTES | 5 MINUTES | 10 MINUTES |
| EXECUTED | | OCCURRED | OCCURRED | OCCURRED |
| NOT EXECUTED | $10g/m^2$ | OCCURRED | OCCURRED | OCCURRED |
| | $20g/m^2$ | OCCURRED | OCCURRED | OCCURRED |
| | $30g/m^2$ | NON OCCURRED | NON OCCURRED | NON OCCURRED |
| | $40g/m^2$ | NON OCCURRED | NON OCCURRED | NON OCCURRED |
| | $50g/m^2$ | NON OCCURRED | NON OCCURRED | NON OCCURRED |
| | $60g/m^2$ | NON OCCURRED | NON OCCURRED | NON OCCURRED |
| | $70g/m^2$ | NON OCCURRED | NON OCCURRED | NON OCCURRED |

FIG. 12

| TONER HOLDING AMOUNT ($g/m^2$) | IMAGE DELETION | FILMING | CLEANING PERFORMANCE |
|---|---|---|---|
| 7 | OCCURRED | NON OCCURRED | GOOD |
| 8 | OCCURRED | NON OCCURRED | GOOD |
| 9 | OCCURRED | NON OCCURRED | GOOD |
| 20 | OCCURRED | NON OCCURRED | GOOD |
| 30 | NON OCCURRED | NON OCCURRED | GOOD |
| 40 | NON OCCURRED | NON OCCURRED | GOOD |
| 65 | NON OCCURRED | NON OCCURRED | GOOD |
| 90 | NON OCCURRED | NON OCCURRED | GOOD |
| 108 | NON OCCURRED | NON OCCURRED | GOOD |
| 132 | NON OCCURRED | NON OCCURRED | GOOD |
| 150 | NON OCCURRED | NON OCCURRED | GOOD |
| 154 | NON OCCURRED | NON OCCURRED | POOR |
| 163 | NON OCCURRED | NON OCCURRED | POOR |
| 170 | NON OCCURRED | NON OCCURRED | EXTREMELY POOR |
| 186 | NON OCCURRED | NON OCCURRED | EXTREMELY POOR |

IMAGE FORMING APPARATUS AND CLEANING DEVICE

CROSS-REFERENCE TO RELATED APPLICATIONS

This application is based on and claims priority under 35 USC 119 from Japanese Patent Application No. 2006-170185 filed Jun. 20, 2006.

BACKGROUND

1. Technical Field

The present invention relates to an image forming apparatus utilizing e.g. an electrophotographic technology, and a cleaning device.

2. Related Art

In an electrophotographic image forming apparatus such as a copier or a printer, a photoreceptor having e.g. a drum shape (photoreceptor drum) is uniformly charged with a charging device to a predetermined potential, and is exposed to light controlled based on image information, thereby an electrostatic latent image is formed. Then the electrostatic latent image is developed with a developing unit to a toner image, then transferred and fixed onto a recording sheet.

Further, after the transfer in this image formation process, a little amount of residual toner which has not been transferred exists on the surface of the photoreceptor drum. To eliminate the residual toner on the surface of the photoreceptor drum before the photoreceptor drum is charged again, a cleaning device is provided on the downstream side of the transfer unit.

The diameter of the toner particle on the photoreceptor drum after the transfer is several μm to several tens of μm. In the cleaning device, to eliminate the toner particles, a structure having a roller type cleaning member, rotated with a peripheral velocity difference from the photoreceptor drum, in contact with the surface of the photoreceptor drum, or a structure having a blade type cleaning member in edge-contact with the surface of the photoreceptor drum, is generally used.

Further, when the charging device charges the photoreceptor drum, corona effluence such as nitrogen oxides (NOx) is generated by discharge, and attached to the surface of the photoreceptor drum. The corona effluence is much finer than toner particles, and has a characteristic of absorbing moisture and reducing resistance. When the cleaning device is arranged only to eliminate residual toner, the corona effluence attached to the surface of the photoreceptor drum cannot be sufficiently eliminated. Then, the corona effluence which have not been eliminated and remained on the surface of the photoreceptor drum may cause so-called "image deletion" meaning white spot in an image in a high temperature and humidity environment. Accordingly, in some machines where a considerable amount of corona effluence is generated such as a high speed image forming apparatuses and color image forming apparatuses, the cleaning device is arranged so as to eliminate corona effluence in addition to toner particles.

SUMMARY

According to an aspect of the invention, an image forming apparatus includes: an image carrier that carries an image; a developing unit that develops the image on the image carrier into a toner image; a transfer unit that transfers the toner image carried on the image carrier onto a transfer medium; and a cleaning unit that cleans residual toner, having not been transferred by the transfer unit, from the image carrier. The cleaning unit includes a cleaning roller member provided in contact with the image carrier and supplied with a predetermined bias voltage, having a surface layer of a conductive fiber cloth, and a conductive roller member provided in contact with the cleaning roller member and supplied with a predetermined bias voltage.

BRIEF DESCRIPTION OF THE DRAWINGS

Exemplary embodiments of the present invention will be described in detail based on the following figures, wherein:

FIG. 7 is a table showing a comparison between toner collection efficiencies in the drum cleaner and the toner collection efficiencies using other conventional cleaning members;

FIG. 10 is a table showing the relation between the execution/nonexecution of corona effluence elimination mode and the occurrence/nonoccurrence of image deletion, and the relation between the amount of toner supplied to the fiber layer of the cleaning roller and the occurrence/nonoccurrence of image deletion in the corona effluence elimination mode, in 2 minutes, 5 minutes and 10 minuets of photoreceptor drum rotation;

FIG. 12 is a table showing evaluation of the relation between the amount of toner held on the fiber layer of the cleaning roller and the occurrence/nonoccurrence of image deletion due to the corona effluence on the surface of the photoreceptor drum, relation between the amount of toner held on the fiber layer of the cleaning roller and occurrence/nonoccurrence of filming due to scraping or the like of the surface of the photoreceptor drum, and the relation between the amount of toner held on the fiber layer of the cleaning roller and cleaning performance.

DETAILED DESCRIPTION

Hereinafter, exemplary embodiments of the present invention will be described in detail with reference to the accompanying drawings.

Exemplary Embodiment 1

Figure 1:
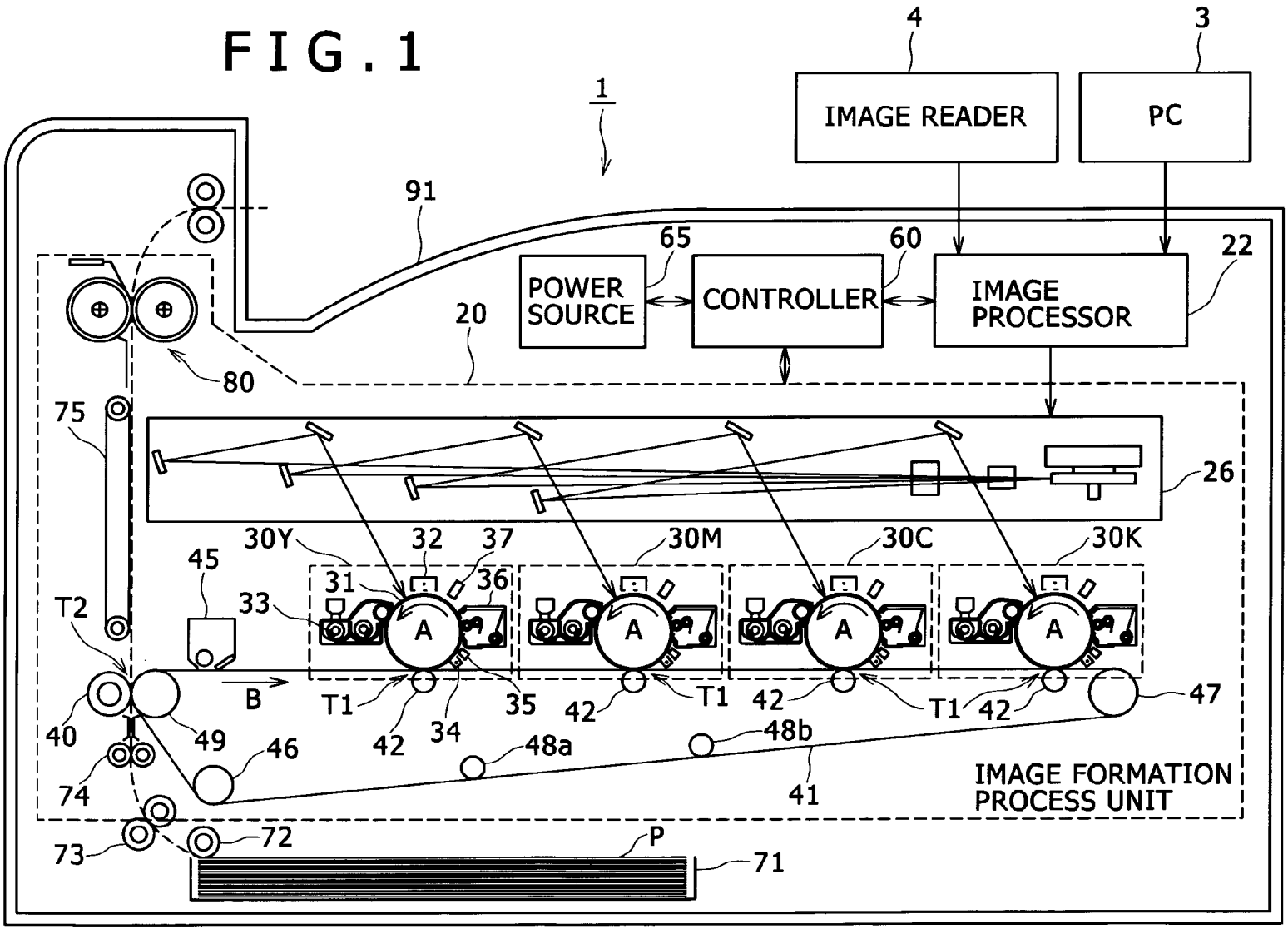
FIG. 1 is a cross-sectional view showing the structure of a color printer of the present invention.

FIG. 1 is a cross-sectional view showing the structure of a color printer 1 as an example of an image forming apparatus to which this exemplary embodiment is applied. In FIG. 1, the color printer 1 is a so-called tandem type printer having an image formation process unit 20 which performs image formation in correspondence with respective color image data, an image processor 22 connected to a personal computer (PC) 3 or an image reader 4 such as a scanner, which performs predetermined image processing on received image data, a controller 60 which controls operations of the respective constituent elements of the color printer 1, and a power source 65 to supply electric power to the respective constituent elements of the color printer 1.

Figure 2:
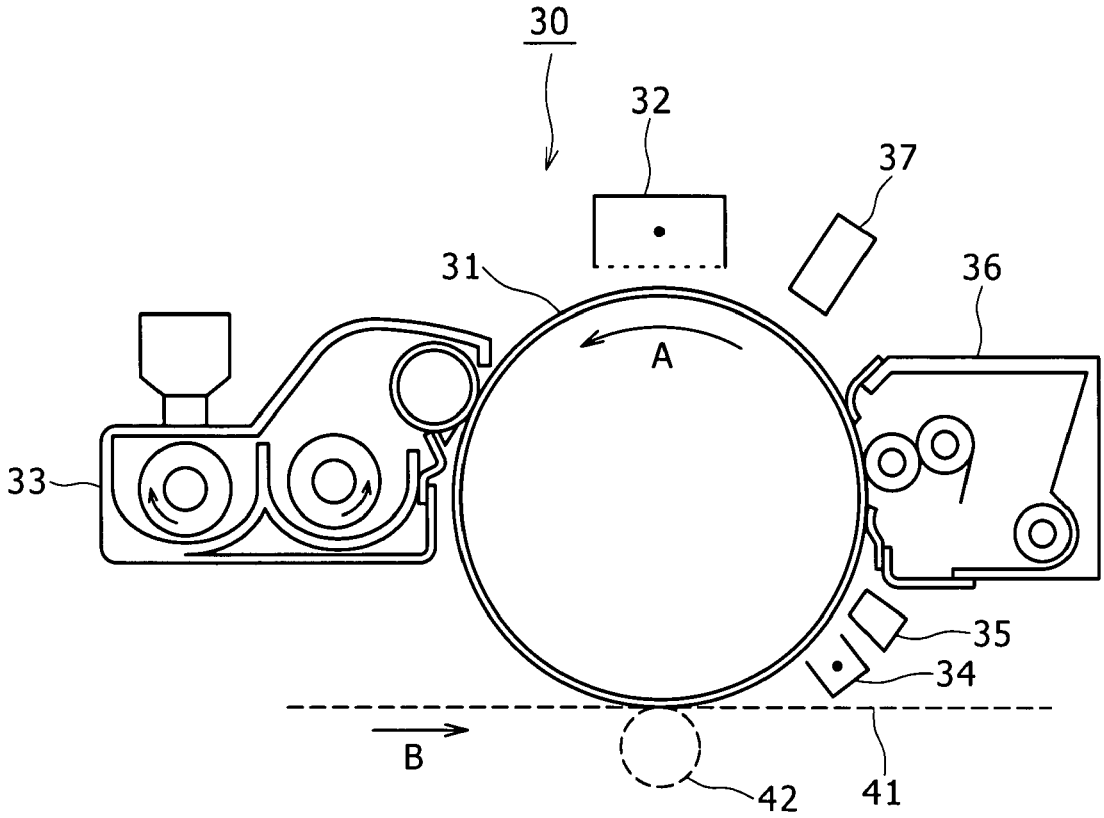
FIG. 2 is a cross-sectional view showing the structure of an image forming unit.

The image formation process unit 20 has four image forming units 30Y, 30M, 30C and 30K (hereinafter, generally denoted as an "image forming unit 30") arrayed in parallel at constant intervals. FIG. 2 is a cross-sectional view showing the structure of the image forming unit 30. As shown in FIG. 2, the image forming unit 30 has a photoreceptor drum 31 as an image carrier which is rotated in an arrow A direction while an electrostatic latent image is formed and further a toner image is formed, a charger 32 having, e.g. a scorotron, which uniformly charges the surface of the photoreceptor drum 31 at a predetermined potential, a developing unit 33 which develops the electrostatic latent image formed on the photoreceptor drum 31, a pre-cleaning charger 34 to turn the charge polarity of residual toner or the like on the surface of the photoreceptor drum 31 after transfer to a predetermined polarity (e.g., to negative polarity), an eliminator lamp 35 which diselectrifies the surface electric charge on the photoreceptor drum 31 after the transfer, a drum cleaner 36 as an example of the cleaning device (cleaning unit) which cleans the residual toner or the like on the surface of the photoreceptor drum 31 after the transfer, and an erase lamp 37 which deletes the trace of a latent image before charging.

The respective image forming units 30Y, 30M, 30C and 30K have approximately the same structure except toner contained in the developing unit 33.

Further, the image formation process unit 20 is provided with a laser exposure device 26 which exposes the photoreceptor drum 31 provided in the respective image formation units 30, an intermediate transfer belt 41 on which respective color toner images formed on the respective photoreceptor drums 31 of the image forming units 30 are superposed and transferred, a first transfer roller 42 which sequentially transfers (first transfers) the respective color toner images formed in the respective image formation units 30 onto the intermediate transfer belt 41 by a first transfer unit T1, a second transfer roller 40 which transfers (second transfers) the superposed toner image on the intermediate transfer belt 41 onto a sheet P as a print material (recording paper) by a second transfer unit T2, and a fixing device 80 which fixes the toner image onto the sheet P.

In the color printer 1 of this exemplary embodiment, an image forming operation is performed by the image formation process unit 20 under the control of the controller 60. More particularly, image data of respective color components inputted from the PC 3 or the image reader 4 is subjected to predetermined image processing by the image processor 22, then supplied to the laser exposure unit 26. The laser exposure unit 26 exposes the respective photoreceptor drums 31 in the image forming units 30. For example, in the yellow (Y) image forming unit 30Y, the photoreceptor drum 31 uniformly charged to a predetermined potential by the charger 32 is scan-exposed with a laser beam modulated based on yellow (Y) component image data by the laser exposure unit 26. Then a yellow (Y) component electrostatic latent image is formed on the photoreceptor drum 31. The electrostatic latent image is developed by the developing unit 33, and a yellow (Y) toner image is formed on the photoreceptor drum 31. Similarly, magenta (M), cyan (C) and black (K) toner images are formed in the image forming units 30M, 30C and 30K. Note that the toner used in the developing unit 33 of this exemplary embodiment has a negative polarity.

The respective color toner images in the respective image forming units 30 are sequentially transferred onto the intermediate transfer belt 41 circulating in an arrow B direction in FIG. 1 with the first transfer roller 42. Thus a toner image (superposed toner image) is formed by superposing the respective color toner images on the intermediate transfer belt 41. The superposed toner image is conveyed toward the second transfer unit T2 provided with the second transfer roller 40 and a backup roller 49 in accordance with movement of the intermediate transfer belt 41. On the other hand, the sheet P is taken out with a pickup roller 72 from a paper tray 71, and conveyed with a conveyance roller 73 one by one to the position of a registration roller 74.

When the superposed toner image is conveyed to the second transfer unit T2, the sheet P is supplied from the registration roller 74 to the second transfer unit T2 at timing of conveyance of the toner image to the second transfer unit T2. In the second transfer unit T2, the superposed toner image is electrostatically transferred (second transferred) onto the sheet P by an operation of electric field formed between the second transfer roller 40 and the backup roller 49.

Thereafter, the sheet P on which the superposed toner image has been transferred is removed from the intermediate transfer belt 41, then conveyed to the fixing device 80 while the sheet is attached to the conveyance belt 75. The unfixed toner image on the sheet P conveyed to the fixing device 80 is subjected to fixing processing using heat and pressure by the fixing device 80 and is fixed onto the sheet P. Then the sheet P carrying the fixed image is conveyed to a discharged paper stacking unit 91 provided in a discharge portion of the image forming apparatus. On the other hand, toner (transfer residual toner) attached to the intermediate transfer belt 41 after the second transfer is eliminated by a belt cleaner 45 in contact with the intermediate transfer belt 41 after the completion of the second transfer, thus preparation for the next image formation cycle is made.

On the other hand, on the surface of the photoreceptor drum 31 after the transfer processing in the first transfer unit T1, the charge polarity of residual toner on the surface of the photoreceptor drum 31 and toner retransferred from the intermediate transfer belt 41 is turned to negative polarity with the pre-cleaning charger 34. Further, the surface charge of the photoreceptor drum 31 after the transfer is diselectrified by the eliminator lamp 35, thus the surface potential of the photoreceptor drum 31 is reduced to about −50 V. Then the residual toner and the like on the surface of the photoreceptor drum 31 are eliminated by the drum cleaner 36. Further, prior to charging with the charger 32, processing to delete the trace of the latent image caused in the previous image formation cycle is performed by exposure of the entire surface of the photoreceptor drum 31 passed through the drum cleaner 36 with the erase lamp 37.

In the color printer 1 of this exemplary embodiment, the above image formation cycle is repeated.

Next, the drum cleaner 36 of this exemplary embodiment will be described.

Figure 3:
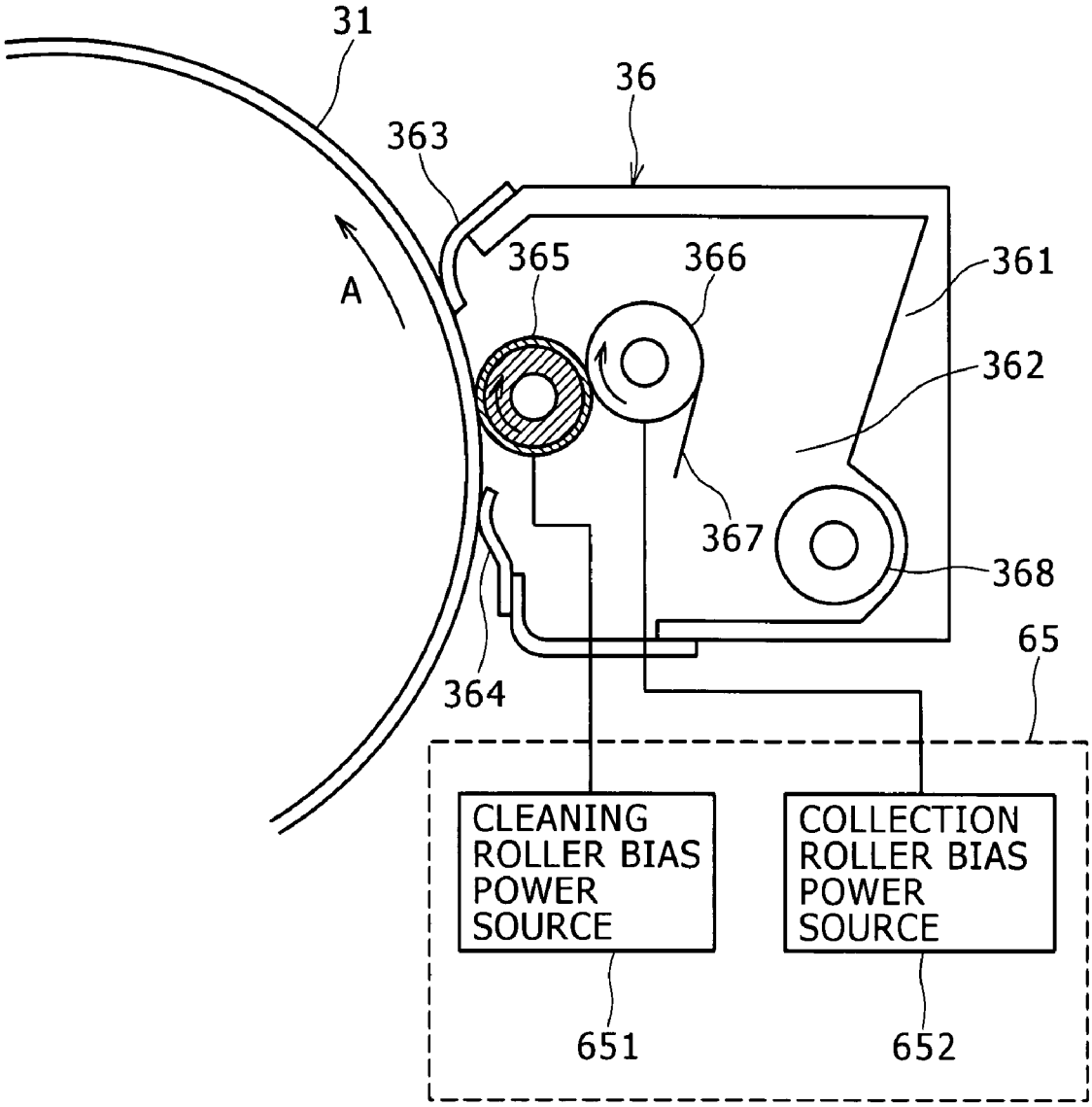
FIG. 3 is a cross-sectional view showing the structure of a drum cleaner.

FIG. 3 is a cross-sectional view showing the structure of the drum cleaner 36. As shown in FIG. 3, the drum cleaner 36 has a housing 361, a toner container 362 to hold toner collected in the housing 361, a downstream side seal 363 and an upstream side seal 364 to shield a gap between the toner container 362 and the photoreceptor drum 31, and a conveyance screw 368 to convey the toner in the toner container 362 to a collection box (not shown) outside the image forming unit 30.

Further, the drum cleaner 36 has a cleaning roller 365 as a cleaning roller member to eliminate toner attached to the photoreceptor drum 31, a collection roller 366 as a roller member to collect the toner eliminated with the cleaning roller 365, and a scraper 367 to scrape toner transferred onto the surface of the collection roller 366. The cleaning roller 365 is supplied with a predetermined bias voltage from a cleaning roller bias power source 651 provided in the power source 65. The collection roller 366 is supplied with a predetermined bias voltage from a collection roller bias power source 652 provided in the power source 65.

Figure 4:
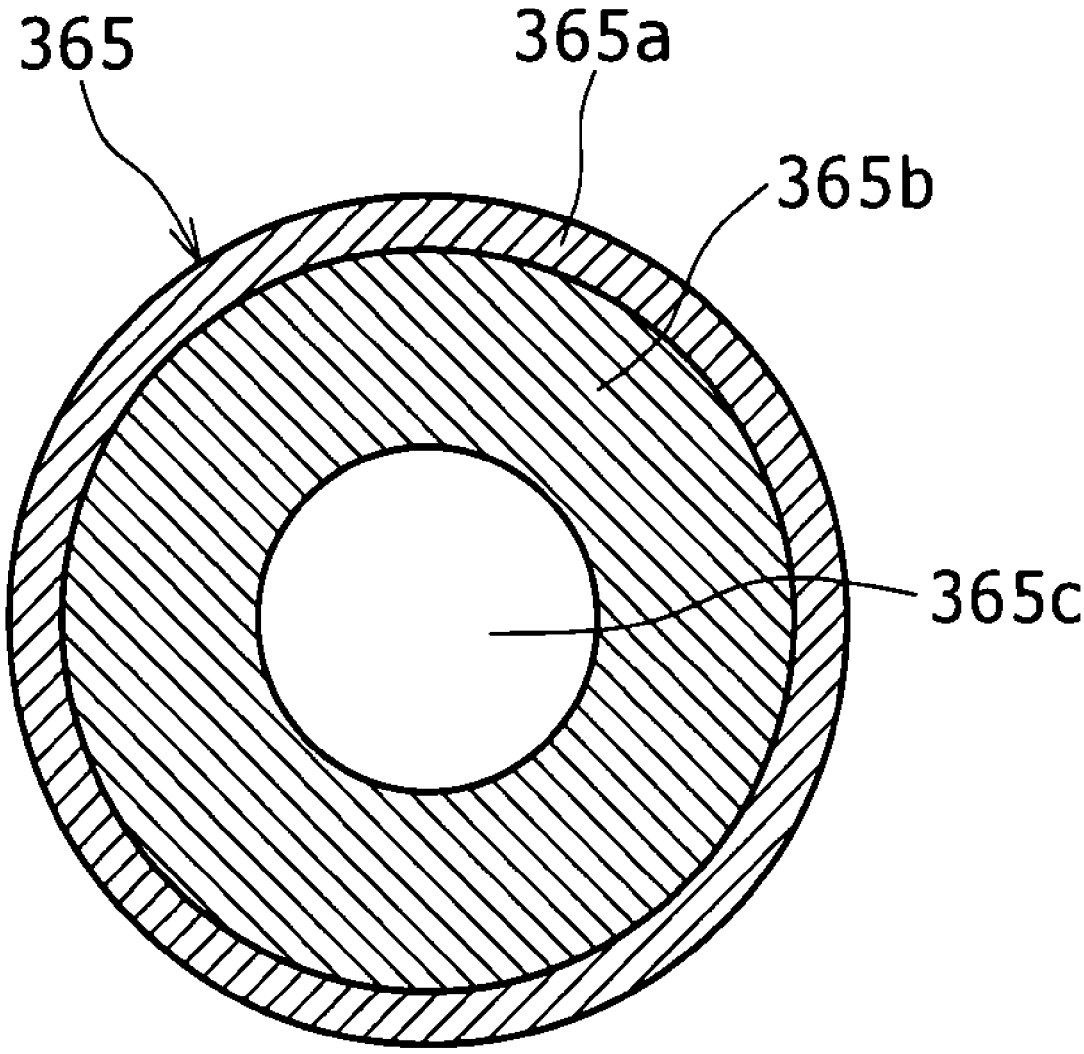
FIG. 4 is a cross-sectional view showing the structure of a cleaning roller.

The cleaning roller 365 is a roller having an outer diameter of 12 mm rotatably supported with the housing 361. As shown in FIG. 4 (showing the cross-sectional structure of the cleaning roller 365), the cleaning roller 365 has a shaft 365*c* having a diameter of 6 mm, an elastic layer 365*b* fixed around the shaft 365*c*, and a fiber layer (surface layer) 365*a* having a layer thickness of 900 μm covering the surface of the elastic layer 365*b*.

The shaft 365*c* is a cylindrical roller of metal such as iron or SUS. The elastic layer 365*b* is a sponge type conductive cylindrical roller of urethane foam containing conductive material such as carbon black. Note that urethane foam is used here but rubber material such as NBR, SBR or EPDM can be arbitrarily selected.

The fiber layer 365*a* is a cloth where conductive fiber is braided, a cloth where the conductive fiber is woven, or an unwoven cloth of the conductive fiber. As the conductive fiber, a split yarn of nylon conductive fiber including distributed carbon black (e.g., a yarn having a thickness of 0.5 denier (248T/450F) by KB SEIREN CO.) is used. As the surface area of the fiber layer 365*a* can be increased by using such very thin conductive fiber, a large amount of toner can be held, and cleaning performance can be increased. In this case, from the viewpoint of toner holding characteristic and cleaning performance, conductive fiber having a thickness of 2 denier (diameter: about 15 μm) or thinner, or more particularly, 1 denier (diameter: about 11 μm) or thinner, is appropriate.

Further, as an unwoven cloth, a dry unwoven cloth, a sponge band, a wet unwoven cloth and the like are available. In this exemplary embodiment, a dry unwoven cloth is used. The dry unwoven cloth is a thin sheet of fiber having a length of several cm, formed using a card or air random machine. In this exemplary embodiment, several sheets are overlaid in accordance with necessity. The fiber joint is made by entwining the fiber with a high pressure jet of water with a very narrow stream.

Note that in the fiber layer 365*a*, the conductive fiber may be mixed with insulating fiber for reinforcement of durability of the fiber layer 365*a*.

In this manner, in the drum cleaner 36 of this exemplary embodiment, as the fiber layer 365*a* using soft conductive fiber is provided on the surface of the cleaner, and the elastic layer 365*b* is formed under the fiber layer 365*a*, the frictional sliding force with respect to the surface of the photoreceptor drum 31 is lowered.

Especially, as the elastic layer 365*b* and the fiber layer 365*a* are laminated, the elasticity of the cleaning roller 365 can be freely adjusted. Accordingly, a low frictional sliding force can be set in correspondence with the surface characteristic of the photoreceptor drum 31.

Further, the cleaning roller can be set in soft contact with the collection roller 366 with close contact.

The cleaning roller 365 is provided in contact with the photoreceptor drum 31 along the axial direction of the drum, and is rotated in a direction the same as the rotational direction of the photoreceptor drum 31 in the contact portion. The rotational speed (peripheral velocity) of the cleaning roller 365 is set to about 0.9 times of the peripheral velocity of the photoreceptor drum 31. Note that the rotational direction and the rotational speed are not limited to the above setting but may be arbitrarily set in accordance with the type of the photoreceptor 31, toner and the like.

The collection roller 366 is a roller having an outer diameter of 12 mm rotatably supported with the housing 361. The collection roller 366 is formed of phenol resin containing distributed carbon black to adjust its resistant value. Note that metal such as iron or SUS may be used as the collection roller. In such case, to smoothly perform sliding with respect to the scraper 367, the surface of the collection roller may be coated with fluorine resin such as Teflon (registered trademark). However, the invention is not limited to such arrangement but arbitrary arrangement can be selected in correspondence with the system.

The collection roller 366 is provided in contact with the cleaning roller 365 along the axial direction of the cleaning roller, and is rotated in a direction opposite to the rotational direction of the cleaning roller 365 in the contact portion.

The scraper 367 is a plate member formed of metal such as iron or SUS. The scraper 367 is fixedly provided in counter contact with respect to the rotational direction of the collection roller 366 along the axial direction of the collection roller 366. The scraper 367 scrapes toner transferred on the collection roller 366 into the toner container 362.

The toner in the toner container 362 is conveyed with the conveyance screw 368 into the collection box (not shown) outside the image forming unit 30.

Next, a cleaning operation of the drum cleaner 36 of this exemplary embodiment will be described.

As described above, when the photoreceptor drum 31 is rotated to the position where the drum cleaner 36 is provided, the charge polarity of residual toner on the surface of the photoreceptor drum 31 is turned to negative polarity with the pre-cleaning charger 34. At the same time, the surface potential of the photoreceptor drum 31 is lowered to about −50 V with the eliminator lamp 35.

In this state, in the drum cleaner 36, a bias voltage of +300 V is applied from the cleaning roller bias power source 651 to the cleaning roller 365. As an electric field from the cleaning roller 365 toward the photoreceptor drum 31 is formed, the toner charged to the negative polarity on the surface of the photoreceptor drum 31 is electrically attracted to the cleaning roller 365.

As described above, in the drum cleaner 36 of this exemplary embodiment, as the fiber layer 365*a* using soft conductive fiber is provided on the surface of the drum, the mechanical frictional sliding force with respect to the surface of the photoreceptor drum 31 is lowered. Accordingly, the frictional sliding force of the cleaning roller 365 with respect to the surface of the photoreceptor drum 31 is low, and the residual toner is collected by electric attraction force.

In this arrangement, scraping and scratching of the surface of the photoreceptor drum 31 are suppressed, and high cleaning performance can be attained.

That is, when the mechanical frictional sliding force of the cleaning member (cleaning roller 365 in this exemplary embodiment) is increased, the scraping of the surface of the photoreceptor drum 31 with the cleaning member is enhanced. In addition, when the surface of the photoreceptor 31 is scraped, the scraped component of the photoreceptor drum 31 is fixed to the surface of the photoreceptor drum 31 due to the high frictional sliding force of the cleaning member. Further, when the component of the photoreceptor drum 31 is fixed, the toner component is fixed with the component of the photoreceptor drum as a core. Thus spot or raindrop pattern of toner attached areas are formed on the surface of the photoreceptor drum 31. This phenomenon is called "filming" which causes image formation errors such as spot or raindrop pattern of white portions. Further, the scratches of the surface of the photoreceptor drum 31 by scraping of the photoreceptor drum may cause image formation errors such as stripe-shaped blot.

On the other hand, in the drum cleaner 36 of this exemplary embodiment, the occurrence of the above-described image formation errors can be suppressed by setting the mechanical frictional sliding force of the cleaning roller 365 with respect to the surface of the photoreceptor drum 31 to a lower level.

Further, the toner electrically attracted to the cleaning roller 365 is held on the fiber layer 365*a*. As described above, since very thin conductive fiber is used as the fiber layer 365*a*, the fiber layer has a very large surface area to hold a large amount of toner. Accordingly, the fiber layer 365*a* has high cleaning performance.

In the drum cleaner 36 of this exemplary embodiment, a predetermined voltage difference is set between the cleaning roller 365 and the collection roller 366. As the contact between the cleaning roller 365 and the collection roller 366 is very close, and the rollers are provided in soft contact with each other, the toner collected to the fiber layer 365*a* of the cleaning roller 365 can always be transferred to the collection roller 366 with high efficiency. As the high toner holding capability of the fiber layer 365*a* can always be maintained, in image formation in the color printer 1, the high cleaning performance of the cleaning roller 365 can always be maintained.

As described above, in the drum cleaner 36 of this exemplary embodiment, the bias voltage applied from the cleaning roller bias power source 651 to the cleaning roller 365 is set to +300 V. When the voltage difference between the cleaning roller 365 and the photoreceptor drum 31 is 400 V or higher, discharge occurs between the cleaning roller and the photoreceptor drum, which may damage the photoreceptor drum 31 or disturb formation of electric field for effective cleaning processing. On the other hand, when the voltage difference is set to a low value, an electric field for sufficient toner cleaning cannot be obtained between the cleaning roller and the photoreceptor drum 31. Accordingly, the bias voltage for the cleaning roller 365 is set to +300 V so as to obtain a voltage difference of 350 V close to a maximum voltage difference within an allowable range not to cause discharge between the cleaning roller and the photoreceptor drum 31 with a surface potential reduced to about −50 V with the eliminator lamp 35.

Further, in the drum cleaner 36 of this exemplary embodiment, the bias voltage applied from the collection roller bias power source 652 to the collection roller 366 is set to +700 V. As in the case of the cleaning roller 365, from the viewpoint of suppression of occurrence of discharge between the collection roller 366 and the cleaning roller 365 and full utilization of cleaning performance of the collection roller 366 to the cleaning roller 365, the bias voltage is set so as to obtain a voltage difference 400 V close to a maximum voltage difference within an allowable range not to cause discharge between the collection roller and the cleaning roller 365 applied with the voltage of +300 V.

FIG. 7 is a table showing a comparison between toner collection efficiencies in the drum cleaner 36 and toner collection efficiencies using other conventional cleaning members in place of the cleaning roller 365 of this exemplary embodiment.

In FIG. 7, first, the cleaning roller 365 of this exemplary embodiment is brought into contact with the photoreceptor drum 31 to clean a predetermined amount of residual toner, thereby the predetermined amount of toner is held on the cleaning roller 365. Thereafter, the collection roller 366 and the scraper 367 are attached, and the amount of toner collected with the scraper 367 via the collection roller 366 is measured, thereby the collection efficiency (%) is calculated. This collection efficiency is compared with that obtained in use of new cleaning roller 365 (that is, in an initial status) and that obtained after execution of 50 kPV (kilo Print Volume) printing.

Further, as other conventional cleaning members in place of the cleaning roller 365, toner collection efficiencies are calculated in a drum cleaning using a brush roller, a foamed roller and a rubber roller. Further, a toner collection efficiency is also calculated in an arrangement where a sweeping member like the scraper 367 is provided in direct contact with the collection roller 365.

From the results of measurement in FIG. 7, in the drum cleaner 36 of this exemplary embodiment using the cleaning roller 365, in the initial status and the status after execution of 50 kPV printing, a high toner collection efficiency of about 90% can be attained.

Since the contact between the cleaning roller 365 and the collection roller 366 is very close, the toner collection efficiency is high even in the initial status. Further, since the fiber layer 365*a* is in soft contact with the collection roller 366, the friction between the cleaning roller 365 and the collection roller 366 is low, and damage to the rollers is suppressed, the high collection efficiency can be maintained after 50 kPV printing.

On the other hand, when the brush roller is used, as toner collected from the photoreceptor drum 31 enters between bristles on the brush, the toner collection efficiency is low in the initial status and after 50 kPV printing. Further, after the 50 kPV printing, a portion damaged with the bristles on the brush is found on the collection roller, and toner filming is found in the portion. Further, the collection efficiency is partially lower.

In the case of the foamed roller, a comparatively high collection efficiency is obtained in the initial status; however, after 50 kPV printing, as toner enters formed cells and the toner is fixed there, the toner collection efficiency is lowered.

In the case of the rubber roller, the maximum collection efficiency is obtained in the initial status. However, after the 50 kPV printing, as the friction between the rubber roller and the collection roller 366 is high, a large number of scratches occur on the surface of the rubber roller, and at the same time, toner is fixed to the scratches. The collection efficiency is exponentially lowered.

Further, in the case where the sweeping member like the scraper 367 is in direct contact with the collection roller 365, when the sweeping member is forcedly brought into contact with the cleaning roller 365, the sweeping member rips the fiber layer 365*a*. Accordingly, the sweeping member cannot be forcedly brought into contact with the cleaning roller. Further, the toner collection is performed only by a mechanical force, but collection utilizing an electrostatic force cannot be performed. Accordingly, the toner collection efficiency is low in the initial status and the status after the 50 kPV printing.

Thus, it is substantiated from the result of the measurement in FIG. 7 that a high toner collection efficiency can be realized in the drum cleaner 36 of this exemplary embodiment. In the drum cleaner 36 of this exemplary embodiment, since high cleaning performance can be maintained for a long term in the fiber layer 365*a* of the cleaning roller 365, upon image formation in the color printer 1, high cleaning performance in the cleaning roller 365 can be obtained.

As described above, in the color printer 1 of this exemplary embodiment, as the fiber layer 365*a* of conductive fiber is provided on the surface of the cleaning roller 365, the frictional sliding force of the cleaning roller 365 with respect to the surface of the photoreceptor drum 31 can be set to a low level. At the same time, as the collection roller 366 with a predetermined potential difference with respect to the cleaning roller 365 is in contact with the fiber layer 365*a* holding toner and the cleaning roller is in soft contact with the collection roller 366 with close contact, toner can be collected from the cleaning roller 365 to the collection roller 366 with high collection efficiency.

In this arrangement, the residual toner, corona effluence and the like can be effectively eliminated from the surface of the photoreceptor drum 31 while the occurrence of image formation errors such as image deletion and filming can be suppressed.

Exemplary Embodiment 2

In Exemplary Embodiment 1, the drum cleaner 36 has the cleaning roller 365 with the fiber layer 365*a* for frictional sliding against the surface of the photoreceptor drum 31. In this exemplary embodiment, the drum cleaner 36 further has a brush roller for frictional sliding against the surface of the photoreceptor drum 31 on the downstream side of the cleaning roller 365. Note that constituent elements corresponding to those of Exemplary Embodiment 1 have the same reference numerals, and detailed explanations of the elements will be omitted.

Figure 8:
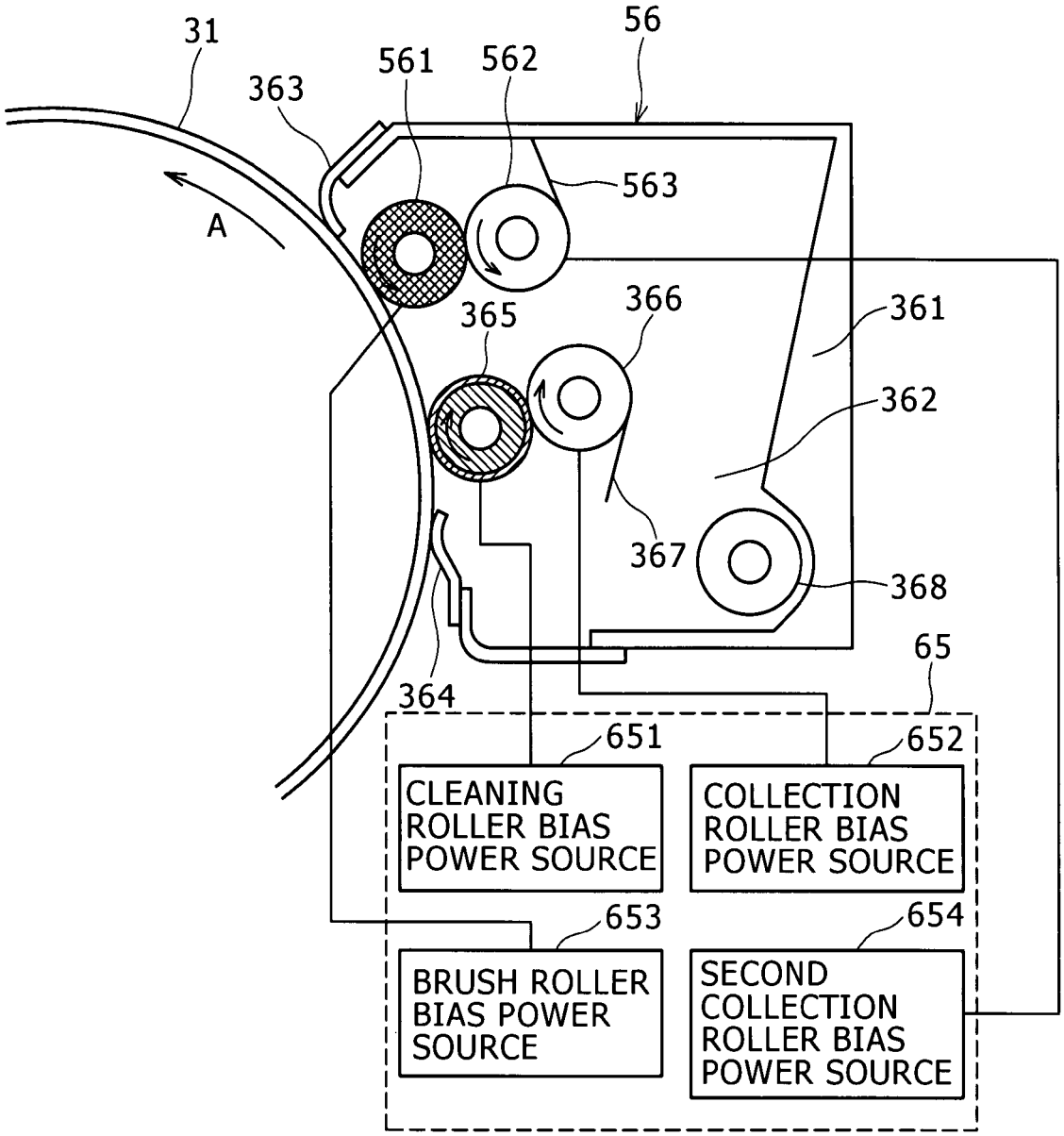
FIG. 8 is a cross-sectional view showing another structure of the drum cleaner.

FIG. 8 is a cross-sectional view showing the structure of a drum cleaner 56 according to this exemplary embodiment. As shown in FIG. 8, the drum cleaner 56 of this exemplary embodiment has a brush roller 561 as a second cleaning member and a second collection roller 562 on the downstream side of the cleaning roller 365 and the collection roller 366. The brush roller 561 is supplied with a predetermined bias voltage from a brush roller bias power source 653 provided in the power source 65. The second collection roller 562 is supplied with a predetermined bias voltage from a second collection roller bias power source 564 provided in the power source 65.

Note that the other constituent elements are approximately the same as those of the drum cleaner 36 of Exemplary Embodiment 1.

The brush roller 561 is a roller having an outer diameter of 12 mm rotatably supported with the housing 361. A flexible conductive brush formed of e.g. nylon conductive fiber including distributed carbon black is provided around a shaft having a diameter of 5 mm. The conductive fiber is the same as that of the surface of the cleaning roller 365. The fiber has a thickness of 0.5 d, a density of 486 Kf/inch$^2$, and a length of 2.5 mm. As the conductive fiber is fine fiber having the thickness of 0.5 d, it is flexible, and secondary troubles such as scratches of the photoreceptor drum 31 can be suppressed. Note that the thickness, density and length of the brush bristles are not limited to this arrangement, but may be appropriately determined in accordance with the hardness of the photoreceptor drum 31, the compatibility with the toner and the like.

The brush roller 561 is provided in contact with the photoreceptor drum 31 along the axial direction of the photoreceptor drum 31. The brush roller 561 is rotated in a direction opposite to the rotation of the photoreceptor drum 31 in the contact portion. As the drum cleaner 56 of this exemplary embodiment has a flexible brush, the frictional sliding force of the brush roller 561 with respect to the surface of the photoreceptor drum 31 is set to a low level.

Further, the second collection roller 562 is a roller having an outer diameter of 12 mm rotatably supported with the housing 361. The second collection roller 562 is formed of phenol resin containing distributed carbon black to adjust its resistant value. Note that metal such as iron or SUS may be used as the second collection roller. In such case, to smoothly perform sliding with respect to the scraper 367, the surface of the collection roller may be coated with fluorine resin such as Teflon (registered trademark). However, the second collection roller 562 is not limited to this arrangement, but an arbitrary arrangement may be selected in correspondence with the system.

The second collection roller 562 is provided in contact with the brush roller 561 along the axial direction of the brush roller 561, and is rotated in a direction opposite to the rotation of the brush roller 561 in the contact portion. The rotational speed is about 0.6 times of the peripheral velocity of the photoreceptor drum 31. Note that the rotational direction and the rotational speed are not limited to the above setting but may be arbitrarily set in accordance with the system.

The scraper 563 is a plate member formed of metal such as iron or SUS. The scraper 563 is fixedly provided in counter contact with respect to the rotational direction of the second collection roller 562 along the axial direction of the second collection roller 562.

In the drum cleaner 56 of this exemplary embodiment, a bias voltage of e.g. −400 V is supplied from the brush roller bias power source 653 to the brush roller 561. Further, a bias voltage of e.g. −800 V is supplied from the second collection roller bias power source 654 to the second collection roller 562.

In this arrangement, in the residual toner on the surface of the photoreceptor drum 31 after the transfer by the first transfer unit T1 and the toner retransferred from the intermediate transfer belt 41, toner which has not been charged with negative polarity with the pre-cleaning charger 34 (see FIG. 2), i.e., toner having positive polarity, is collected. That is, the brush roller 561 functions as an antipolarity toner cleaning member.

The toner having positive polarity which has not been charged to negative polarity with the pre-cleaning charger 34 cannot be collected with the cleaning roller 365 which is supplied with the bias voltage of about +300 V. Accordingly, the toner with positive polarity which has not been collected with the cleaning roller 365 is electrically collected by applying the bias voltage of about −400 V to the brush roller 561.

The toner collected with the brush roller 561 is transferred to the second collection roller 562 by an electric field between the brush roller 561 and the second collection roller 562. Then the toner transferred on the second collection roller 562 is swept with the scraper 563 into the toner container 362. The toner in the toner container 362 is conveyed with the conveyance screw 368 into the collection box (not shown) outside the image forming unit 30.

In the drum cleaner 56 of this exemplary embodiment, as the toner having positive polarity which has not been collected with the cleaning roller 365 is collected with the brush roller 561, the cleaning performance is further improved.

Note that in the drum cleaner 56 of this exemplary embodiment, the brush roller 561 is provided as a second cleaning member on the downstream side of the cleaning roller 365. However, a cleaning roller having the same construction of that of the cleaning roller 365 may be provided.

Exemplary Embodiment 3

In Exemplary Embodiment 1, the drum cleaner 36 has the cleaning roller 365 with the fiber layer 365*a* on the surface for frictional sliding with respect to the surface of the photoreceptor drum 31. In this exemplary embodiment, the drum cleaner 36 has a cleaning blade in edge contact with the surface of the photoreceptor drum 31 on the downstream side of the cleaning roller 365. Note that constituent elements corresponding to those of Exemplary Embodiment 1 have the same reference numerals, and detailed explanations of the elements will be omitted.

Figure 9:
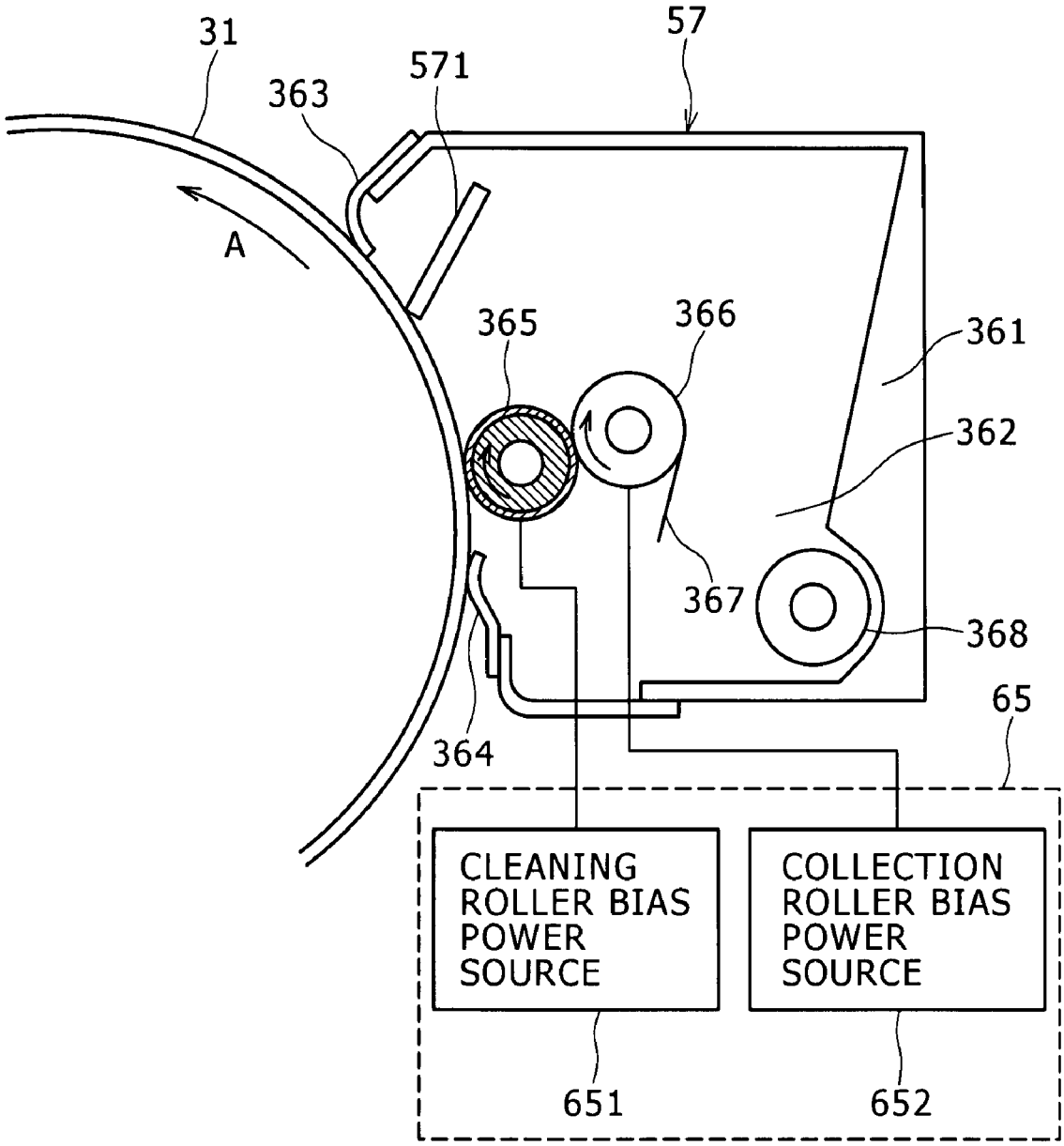
FIG. 9 is a cross-sectional view showing another structure of the drum cleaner.

FIG. 9 is a cross-sectional view showing the structure of a drum cleaner 57 according to this exemplary embodiment. As shown in FIG. 9, the drum cleaner 57 of this exemplary embodiment has a cleaning blade 571 on the downstream side of the cleaning roller 365 and the collection roller 366.

Note that the other constituent elements are approximately the same those of the drum cleaner 36 of Exemplary Embodiment 1.

The cleaning blade 571 is a plate member of elastic material such as urethane rubber or elastomer. The cleaning blade 571 is fixedly provided in counter contact with respect to the rotational direction of the photoreceptor drum 31 along the axial direction of the photoreceptor drum 31.

In this arrangement, in the residual toner on the surface of the photoreceptor drum 31 after the transfer by the first transfer unit T1 and the toner retransferred from the intermediate transfer belt 41, toner which has not been charged to negative polarity with the pre-cleaning charger 34 (see FIG. 2), i.e., toner having positive polarity, is collected.

In the drum cleaner 57 of this exemplary embodiment, as described above, the toner having positive polarity which has not been charged to negative polarity with the pre-cleaning charger 34 cannot be collected with the cleaning roller 365 which is applied with the bias voltage of about +300 V. Accordingly, the toner having positive polarity which has not been collected with the cleaning roller 365 is collected with the cleaning blade 571 in counter contact with the photoreceptor drum. That is, the cleaning blade 571 functions as an antipolarity toner cleaning member.

The toner swept with the cleaning blade 571 is collected into the toner container 362. The toner contained in the toner container 362 is conveyed with the conveyance screw 368 to the collection box (not shown) outside the image forming unit 30.

In the drum cleaner 57 of this exemplary embodiment, as the toner having positive polarity which has not been collected with the cleaning roller 365 is collected with the cleaning blade 571, the cleaning performance is further improved.

Further, as the corona effluence is eliminated with the cleaning roller 365, the friction coefficient of the surface of the photoreceptor drum 31 due to attachment of corona effluence almost does not rise. Accordingly, the occurrence of curled-up or frictional sliding sound (so-called "squeal") with the cleaning blade 571 can be reduced, and damage or abrasion of the edge of the cleaning blade 571 can be almost suppressed.

Exemplary Embodiment 4

In Exemplary Embodiment 1, the residual toner and corona effluence on the surface of the photoreceptor drum 31 are eliminated by providing the fiber layer 365*a* on the surface of the cleaning roller 365, and providing the collection roller 366 with a predetermined potential difference with respect to the cleaning roller 365 in contact with the cleaning roller. In this exemplary embodiment, a predetermined amount of toner is held on the fiber layer 365*a* at predetermined timing, and in this status, the residual toner and corona effluence on the surface of the photoreceptor drum 31 are eliminated. For example, in high process speed machines such as high-speed image forming apparatuses and color image forming apparatuses, a large amount of corona effluence is generated. In this exemplary embodiment, the function of eliminating the corona effluence is further improved. Note that constituent elements corresponding to those of Exemplary Embodiment 1 have the same reference numerals, and detailed explanations of the elements will be omitted.

The drum cleaner 36 of this exemplary embodiment has the same construction as that of Exemplary Embodiment 1. The bias voltage applied from the cleaning roller bias power source 651 to the cleaning roller 365 is set to +300 V. As in the case of Exemplary Embodiment 1, to suppress the occurrence of discharge and to fully utilize the cleaning performance, the bias voltage for the cleaning roller 365 is +300 V so as to obtain a voltage difference of 350 V close to a maximum voltage difference within an allowable range not to cause discharge between the cleaning roller and the photoreceptor drum 31 with a surface potential reduced to about −50 V by the eliminator lamp 35.

Further, in the drum cleaner 36 of this exemplary embodiment, upon normal image forming operation, the bias voltage applied from the collection roller bias power source 652 to the collection roller 366 is set to +700 V. As in the case of Exemplary Embodiment 1, from the viewpoints of suppression of the occurrence of discharge between the collection roller and the cleaning roller 365 and full utilization of the cleaning performance of the collection roller 366 to the cleaning roller 365, the bias voltage for the collection roller 366 is set to so as to obtain a voltage difference of 400 V close to a maximum voltage difference within an allowable range not to cause discharge between the collection roller and the cleaning roller 365 applied with the voltage set to +300 V.

Note that as in the case of Exemplary Embodiment 1, the voltage difference between the cleaning roller 365 and the collection roller 366 may be set to 200 to 400 V.

By this voltage setting for the cleaning roller 365 and the collection roller 366, a sufficient amount of toner to maintain the cleaning performance of the cleaning roller 365 can be transferred to the collection roller 366. Accordingly, upon image formation in the color printer 1, high cleaning performance of the cleaning roller 365 can always be attained.

On the other hand, in the drum cleaner 36 of this exemplary embodiment, the controller 60 performs a corona effluence elimination mode (toner holding mode) to eliminate corona effluence attached to the photoreceptor drum 31 at predetermined timing.

The corona effluence elimination mode of this exemplary embodiment is performed as follows. That is, when the corona effluence elimination mode is set, the controller 60 forms, e.g., a solid image over the entire area in the widthwise direction of the photoreceptor drum 31 (e.g., A3-sized solid image) in the respective image forming units 30, and turns off the first transfer roller 42 not to perform first transfer processing. Then, almost all the developed toner is supplied to the cleaning roller 365. Then the cleaning roller 365 cleans a large amount of toner, and a predetermined or larger amount of toner, e.g., 30 g/m$^2$ or more toner is held on the fiber layer 365*a*.

Note that the first transfer roller 42 is turned off when the large amount of developed toner is supplied to the cleaning roller 365. However, the invention is not limited to this arrangement, but arbitrary setting may be made in correspondence with the system. For example, it may be arranged such that the first transfer roller 42 is not completely turned off but the transfer electric field is weakened thereby the amount of transfer residual toner is increased, in correspondence with the transfer efficiency or the like.

Further, in the corona effluence elimination mode, the controller 60 sets the bias voltage to be supplied to the collection roller 366 to a low level (e.g., 0 V). In this manner, the transfer of toner from the cleaning roller 365 to the collection roller 366 is almost stopped, and the toner is held on the cleaning roller 365.

Then the photoreceptor drum 31 is rotated for several minutes while the above status is maintained.

In this corona effluence elimination mode, when the photoreceptor drum 31 is rotated while a predetermined or larger amount of toner is held on the cleaning roller 365, the corona effluence attached to the surface of the photoreceptor drum 31 can be effectively eliminated from the photoreceptor drum 31.

The corona effluence elimination is based on the knowledge obtained through an experiment by the present inventors. That is, it is found that when the fiber layer 365*a* holding toner is in contact with the surface of the photoreceptor drum 31, the toner held on the fiber layer 365*a* effectively eliminates the corona effluence attached to the surface of the photoreceptor drum 31. Although the mechanism of corona effluence elimination includes unclear points, it can be presumed that a binder resin component of the toner such as polyethylene or polystyrene has an effect to absorb the corona effluence.

FIG. 10 is a table showing the relation between the execution/nonexecution of corona effluence elimination mode and the occurrence/nonoccurrence of image deletion, and the relation between the amount of toner (g/m$^2$) supplied to the fiber layer 365*a* of the cleaning roller 365 and the occurrence/nonoccurrence of image deletion in the corona effluence elimination mode, in 2 minutes, 5 minutes and 10 minuets of photoreceptor drum rotation.

In the experiment in FIG. 10, printing for 1000 sheets is performed, then evaluation is made based on a halftone image having image percentage of 30% obtained by printing after a lapse of about 24 hours. The corona effluence attached to the surface of the photoreceptor drum 31 gradually absorbs moisture, and as the resistance value of a photoreceptor layer is reduced, white spots due to image deletion easily occur. Accordingly, the evaluation is made using the image printed after the lapse of about 24 hours.

Further, the amount of toner (g/m$^2$) supplied to the fiber layer 365*a* for the evaluation in FIG. 10 is controlled by changing the width of the band-shaped solid image formed over the entire area in the widthwise direction of the photoreceptor drum 31.

As shown in FIG. 10, the image deletion occurs when the corona effluence elimination mode is not performed, or when the amount of toner held on the fiber layer 365*a* is 10 to 20 g/m$^2$ in the corona effluence elimination mode.

On the other hand, the image deletion does not occur when the amount of toner held on the fiber layer 365*a* is 30 to 70 g/m$^2$ in the corona effluence elimination mode.

Accordingly, it is understood from the result of evaluation in FIG. 10 that, to suppress the occurrence of image deletion, 30 g/m$^2$ or more toner may be ensured on the fiber layer 365*a* in the corona effluence elimination mode. Further, it can be considered that the rotation period of the photoreceptor drum 31 is long for reliable corona effluence elimination, but the corona effluence can be sufficiently eliminated in 2 minute rotation of the photoreceptor drum 31.

Further, as shown in FIG. 12 (Exemplary Embodiment 5), even in a case where the corona effluence elimination mode is performed, when the amount of toner held on the fiber layer 365*a* is more than 150 g/m$^2$, such amount is beyond the toner holding capability of the fiber layer 365*a*. In such case, the toner held on the fiber layer 365*a* may be transferred to the photoreceptor drum 31 and the charger 32 may be contaminated with the toner. It is necessary to suppress the toner holding amount on the fiber layer 365*a* to 150 g/m$^2$ or less.

Accordingly, the toner holding amount on the fiber layer 365*a* may be 30 to 150 g/m$^2$ toner.

Further, the timing of corona effluence elimination mode can be appropriately performed. For example, the corona effluence elimination mode may be set at the end of image formation cycle (job end) by a predetermined number (e.g., 500) of print sheets, or the beginning of next image formation cycle (job start), further, at the end of image formation cycle by a predetermined number of print sheets and at the beginning of next image formation cycle, or between image formation cycles.

In this manner, in the color printer 1 of this exemplary embodiment, the corona effluence elimination mode to cause the fiber layer 365*a* to hold a predetermined amount of toner at predetermined timing thereby eliminate corona effluence attached to the photoreceptor drum 31 is performed.

This arrangement improves the effect of elimination of corona effluence attached to the surface of the photoreceptor drum 31, while suppresses the occurrence of image formation errors such as image deletion and filming.

In this exemplary embodiment, only the cleaning roller is used. However, as described in Exemplary Embodiments 3 and 4, a brush cleaner, a roller cleaner, a blade cleaner and the like may be provided on the downstream side.

Exemplary Embodiment 5

In Exemplary Embodiment 4, a predetermined amount of toner is held on the fiber layer 365*a* at predetermined timing and in that status, the residual toner and corona effluence attached to the surface of the photoreceptor drum 31 are eliminated. In this exemplary embodiment, a predetermined amount of toner is always held on the fiber layer 365*a*. In this arrangement, in correspondence with machines which produce a large amount of corona effluence such as high-speed image forming apparatuses and color image forming apparatuses, the effect of corona effluence elimination is improved. Note that constituent elements corresponding to those of Exemplary Embodiment 1 have the same reference numerals, and detailed explanations of the elements will be omitted.

Next, the cleaning operation of the drum cleaner 36 of this exemplary embodiment will be described.

When the photoreceptor drum 31 is rotated to the position where the drum cleaner 36 having the same structure as that of Exemplary Embodiment 1 is provided, the charge polarity of residual toner on the surface of the photoreceptor drum 31 is turned to negative polarity with the pre-cleaning charger 34, and the surface potential of the photoreceptor drum 31 is reduced with the eliminator lamp 35 to about −50 V.

In this status, in the drum cleaner 36, a bias voltage of +300 V is applied from the cleaning roller bias power source 651 to the cleaning roller 365. As an electric field from the cleaning roller 365 toward the photoreceptor drum 31 is formed, the toner charged to negative polarity on the surface of the photoreceptor drum 31 is electrically attracted to the cleaning roller 365. That is, in the drum cleaner 36 of this exemplary embodiment, as the frictional sliding force of the cleaning roller with respect to the surface of the photoreceptor drum 31 is set to a low level, the mechanical collecting force is not increased, but the toner is collected by electrical attraction.

Then, the toner electrically attracted to the cleaning roller 365 is held on the fiber layer 365*a*. As described above, as very thin conductive fiber is used as the fiber layer 365*a*, a large amount of toner can be held.

The bias voltage applied from the cleaning roller bias power source 651 to the cleaning roller 365 is set to +300 V. As in the case of Exemplary Embodiment 1, to suppress the occurrence of discharge and fully utilize the cleaning performance, the bias voltage for the cleaning roller 365 is set to +300 V so as to obtain a voltage difference of 350 V close to a maximum voltage difference within an allowable range not to cause discharge between the cleaning roller and the photoreceptor drum 31 with a surface potential reduced to about −50 V with the eliminator lamp 35.

On the other hand, a bias voltage of +275 V is applied from the collection roller bias power source 652 to the collection roller 366 of this exemplary embodiment. In this manner, a voltage a little lower than that applied to the cleaning roller 365 is applied to the collection roller 366. In the drum cleaner 36 of this exemplary embodiment, a status where a predetermined amount of toner is always held on the fiber layer 365*a* of the cleaning roller 365 is maintained.

That is, in the drum cleaner 36 of this exemplary embodiment, the bias voltage (+275 V) applied to the collection roller 366 is lower than the bias voltage (+300 V) applied to the cleaning roller 365. When the amount of toner held on the fiber layer 365*a* is smaller than a predetermined amount, the effect of potential drop on the surface of the cleaning roller 365 with the toner having negative polarity is low. Then the status where the potential of the collection roller 366 is lower than that of the cleaning roller 365 is maintained. Accordingly, the toner held on the fiber layer 365*a* of the cleaning roller 365 is not collected with the collection roller 366 and held on the fiber layer 365*a*.

However, when the amount of toner held on the fiber layer 365*a* is over the predetermined amount, the effect of potential drop on the surface of the cleaning roller 365 with the toner with negative polarity is high. Then a status where the potential of the collection roller 366 is higher than that of the surface layer of the cleaning roller 365 is formed. In such status, the toner held on the fiber layer 365*a* of the cleaning roller 365 is transferred to the collection roller 366, and collected to the collection roller 366.

When a predetermined amount of toner has been transferred from the cleaning roller 365 to the collection roller 366, again the potential of the collection roller 366 is lower than that of the surface layer of the cleaning roller 365. Then, the transfer of the toner to the collection roller 366 is stopped.

In this manner, by setting the bias voltage applied to the collection roller 366 to a value lower than the bias voltage applied to the cleaning roller 365, the status where a predetermined amount of toner is always held on the fiber layer 365*a* of the cleaning roller 365 can be maintained.

Further, by controlling the voltage difference between the bias voltage applied to the collection roller 366 and the bias voltage applied to the cleaning roller 365, the toner holding amount on the fiber layer 365*a* can be appropriately controlled.

Figure 11:
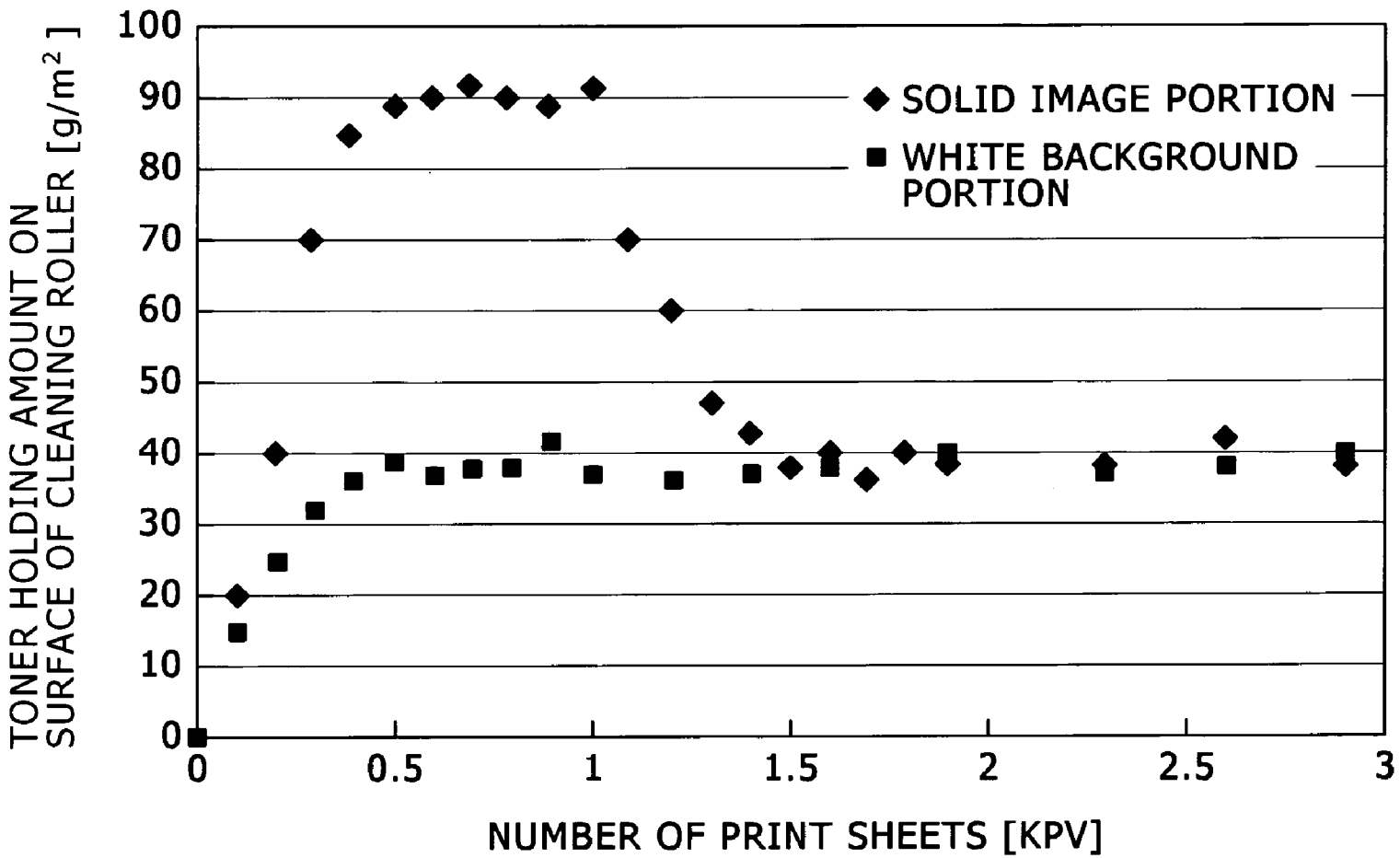
FIG. 11 is a graph showing the amount of toner held on the fiber layer of the cleaning roller.

FIG. 11 shows the result of measurement of the amount of toner held on the fiber layer 365*a* of the cleaning roller 365 when the bias voltage applied to the cleaning roller 365 is +300 V and the bias voltage applied to the collection roller 366 is +275 V.

Figure 5:
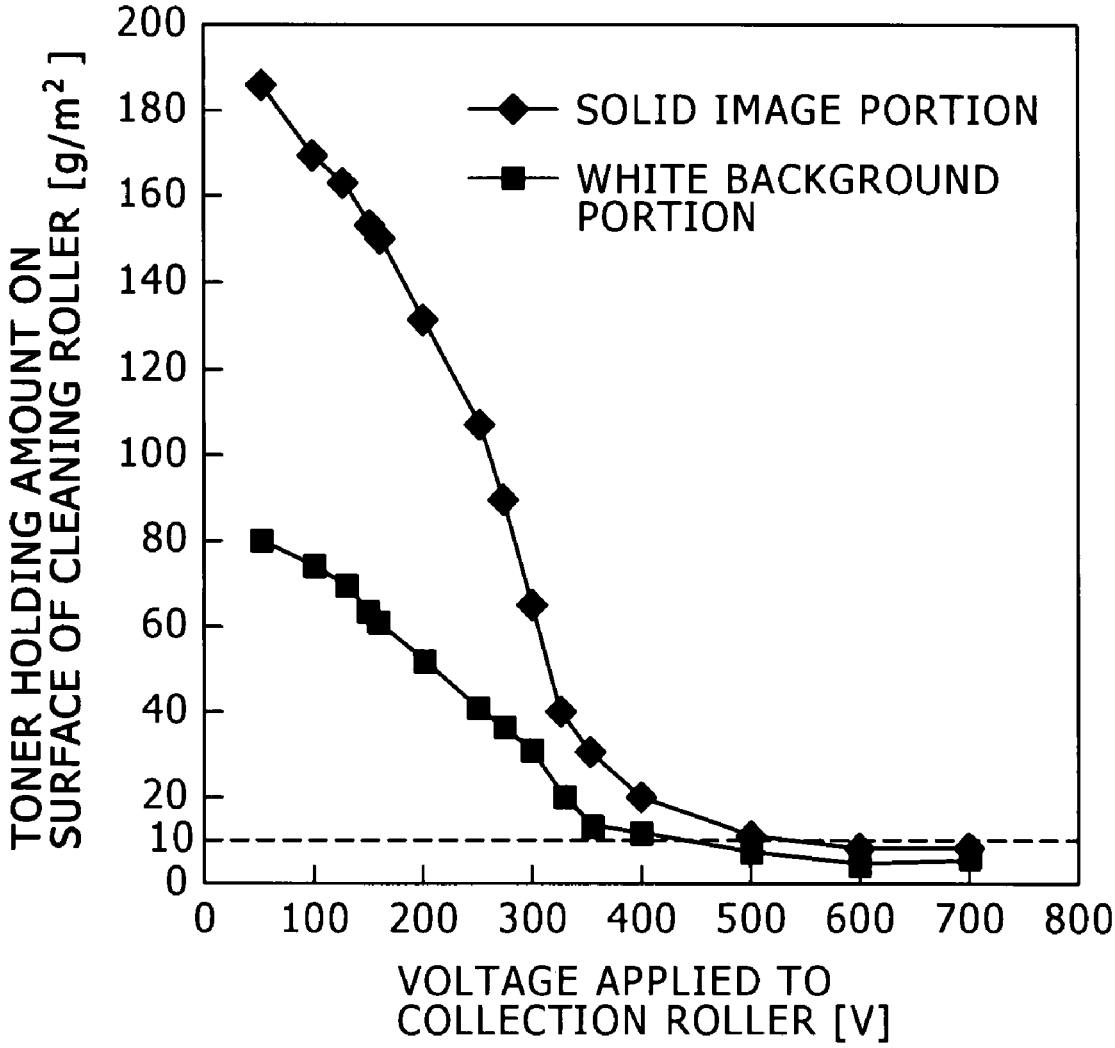
FIG. 5 is a graph showing results of measurement of the amount of toner held on a fiber layer when a bias voltage supplied to a collection roller is changed.
Figure 6:
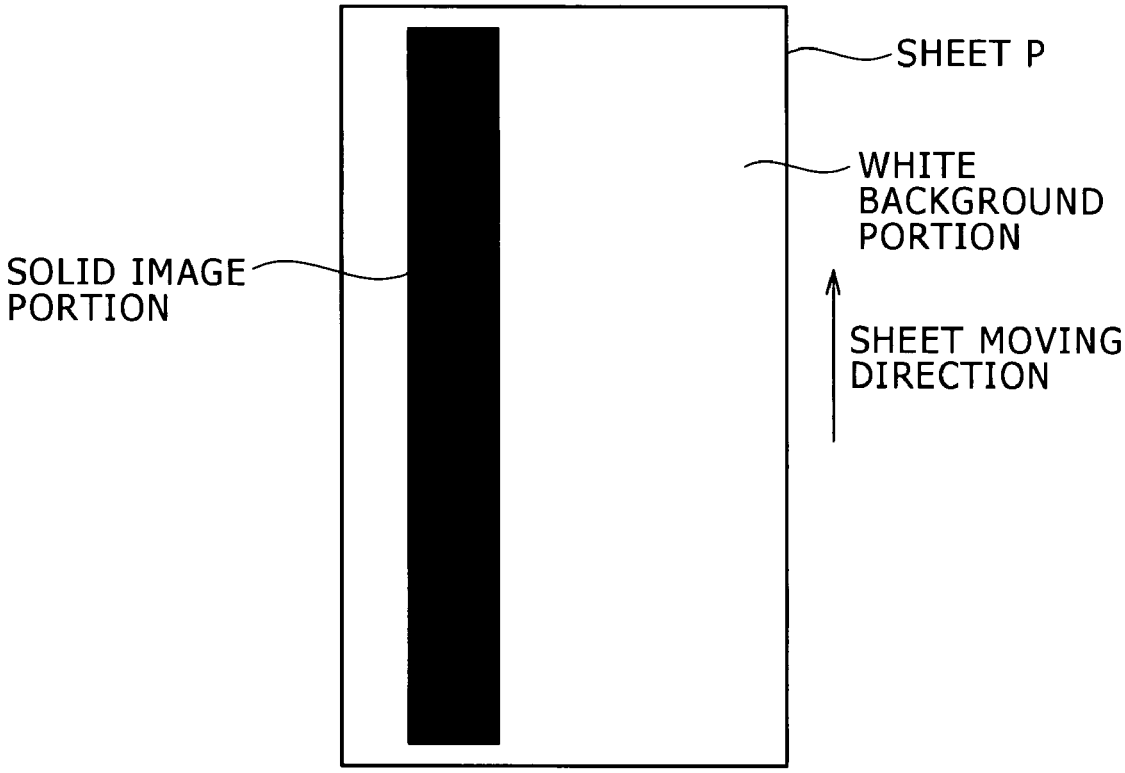
FIG. 6 illustrates an example of a band chart used upon measurement of toner holding amount.

In the experiment in FIG. 11, a band-shaped chart where a band-shaped solid image having a predetermined width is formed toward a conveyance direction of the sheet P is continuously printed for 1000 sheets, then the chart is changed to a complete white background (blank) chart and printing is continuously performed for 2000 sheets. In this case, in an area on the photoreceptor drum 31 corresponding to the solid image of the band-shaped chart, as transfer residual toner, 0.5 $g/m^2$ toner is attached. Further, in the white background chart, as transfer residual toner, 0.01 to 0.02 $g/m^2$ toner is attached. In FIG. 5, the amount of toner (weight per unit area: $g/m^2$) held on the fiber layer 365*a* of the cleaning roller 365 is measured during printing.

As shown in FIG. 11, in continuous printing of the band-shaped chart for 1000 sheets, in the area of the fiber layer 365*a* corresponding to the solid image portion, as 0.5 $g/m^2$ toner is supplied, the toner holding amount is saturated to about 90 $g/m^2$ upon completion of about 500 sheets, then the status is maintained until printing for 1000 sheets has been completed. Thereafter, when the band-shaped chart is changed to the white background chart upon printing 1000 sheets, 0.01 to 0.02 $g/m^2$ toner is supplied, thereby the toner held in the area of the fiber layer 365*a* corresponding to the solid image portion is gradually collected to the collection roller 366, and then the toner holding amount is saturated to about 40 $g/m^2$.

Further, in the areas of the fiber layer 365*a* corresponding to areas other than the solid image portion, 0.01 to 0.02 $g/m^2$ toner is supplied through the printing of the band-shaped chart and the white background chart, thereby the toner holding amount is saturated to about 40 $g/m^2$ upon completion of about 500 sheets, and the status is maintained until printing for 3000 sheets has been completed.

As it is apparent from the result in FIG. 11, by setting the bias voltage to the cleaning roller 365 is set to +300 V and the bias voltage to the collection roller 366 is set to +275 V, in the area of the fiber layer 365*a* where 0.5 $g/m^2$ toner in the solid image portion is supplied, the toner holding amount of about 90 $g/m^2$ is maintained. Further, in the area of the fiber layer 365*a* where 0.01 to 0.02 $g/m^2$ toner in the white background area is supplied, the toner holding amount of about 40 $g/m^2$ is maintained. Accordingly, in the drum cleaner 36 with the voltage settings, the minimum toner holding amount of 40 $g/m^2$ and the maximum toner holding amount of 90 $g/m^2$ are maintained in the fiber layer 365*a*.

As described above, when the charger 32 charges the photoreceptor drum 31 in an image formation cycle, corona effluence such as nitrogen oxides (NOx) is generated by discharging. For example, in high process speed machines such as high-speed image forming apparatuses and color image forming apparatuses, a large amount of corona effluence is generated. When the corona effluence is attached to the surface of the photoreceptor drum 31, they may cause so-called "image deletion" in a high temperature and humidity environment (e.g., 28 C.° and 85% RH). That is, the charge on the surface of the photoreceptor drum 31 is leaked with the corona effluence having reduced resistance in the high temperature and humidity environment, and the latent image potential contrast is lowered. Accordingly, the "image deletion" meaning white spots occur in an image.

In the drum cleaner 36 of this exemplary embodiment, a predetermined amount of toner is always held on the fiber layer 365*a* of the cleaning roller 365, and the fiber layer 365*a* holding toner is frictionally-slided against the surface of the photoreceptor drum 31. This arrangement enables cleaning with enhanced effect of elimination of corona effluence from the surface of the photoreceptor drum 31, and with suppression of the occurrence of image formation errors.

That is, as in the case of Exemplary Embodiment 1, as the frictional sliding force of the cleaning roller 365 with respect to the surface of the photoreceptor drum 31 is set to a low level, the scratching action of the surface of the photoreceptor drum 31 by the cleaning roller 365 is extremely weak. Accordingly, hardly any scratching and damaging to the surface of the photoreceptor drum 31 occur.

Further, even when the surface of the photoreceptor drum 31 is slightly scratched, as the frictional sliding force of the cleaning roller 365 is low, the scratched component of the photoreceptor drum 31 is almost not fixed to the surface of the photoreceptor drum 31.

In addition, the corona effluence attached to the surface of the photoreceptor drum 31 can be more effectively eliminated by performing cleaning, with the fiber layer 365*a* always holding a predetermined amount of toner in contact with the surface of the photoreceptor drum 31.

FIG. 12 is a table showing evaluation of the relation between the toner holding amount (g/m$^2$) held on the fiber layer 365*a* of the cleaning roller 365 and the occurrence/nonoccurrence of image deletion due to the corona effluence on the surface of the photoreceptor drum 31, the relation between the amount of toner held on the fiber layer 365*a* of the cleaning roller 365 and the occurrence/nonoccurrence of filming due to scraping or the like of the surface of the photoreceptor drum 31, and the relation between the amount of toner held on the fiber layer 365*a* of the cleaning roller 365 and cleaning performance, in the drum cleaner 36 of this exemplary embodiment always holding a predetermined amount of toner.

In the experiment in FIG. 12, printing for 10000 sheets is performed, then evaluation is made based on a first print-out image after a lapse of about 24 hours. The corona effluence attached to the surface of the photoreceptor drum 31 gradually absorbs moisture, and as the resistance value of a photoreceptor layer is reduced, white spots due to image deletion easily occur. Accordingly, the evaluation is made using the image printed after the lapse of about 24 hours. Further, the occurrence/nonoccurrence of filming is determined by observation of the surface of the photoreceptor drum 31 through a microscope. Further, the cleaning performance is determined by observation of the surface of the photoreceptor drum 31 passed through the drum cleaner 36.

As shown in FIG. 12, image deletion occurs when the toner holding amount is equal to or less than 20 g/m$^2$, but does not occur when the toner holding amount is equal to or more than 30 g/m$^2$. That is, as long as 30 g/m$^2$ or more toner is held on the fiber layer 365*a*, the corona effluence attached to the surface of the photoreceptor drum 31 can be eliminated from the photoreceptor drum 31 so as to suppress the occurrence of image deletion.

Further, in such case, it is clear from the result of observation of the surface of the photoreceptor drum 31 through the microscope that filming does not occur regardless of the toner holding amount. It can be considered that the filming does not occur since the frictional sliding force of the cleaning roller 365 with respect to the surface of the photoreceptor drum 31 is set to a low level.

On the other hand, when the toner holding amount is over 150 g/m$^2$, as the toner collecting capability of the fiber layer 365*a* is lowered, the cleaning performance cannot be sufficiently attained.

In this manner, from the result of evaluation in FIG. 12, it is understood that to suppress the occurrence of image deletion and filming and to obtain sufficient cleaning performance to the corona effluence, the amount of toner held on the fiber layer 365*a* may be 30 to 150 g/m$^2$.

Note that in another experiment, even when the toner holding amount is 20 g/m$^2$, the occurrence of image deletion can be suppressed by rotating the photoreceptor drum 31 for a predetermined period (e.g., 5 minutes) while toner is held on the fiber layer 365*a*. Accordingly, on the presumption of such rotation operation, the amount of toner held on the fiber layer 365*a* may be set to 20 to 150 g/m$^2$.

Next, the relation between the voltages set for the cleaning roller 365 and the collection roller 366 to set the amount of toner held on the fiber layer 365*a* to 20 to 150 g/m$^2$ will be described.

Figure 13:
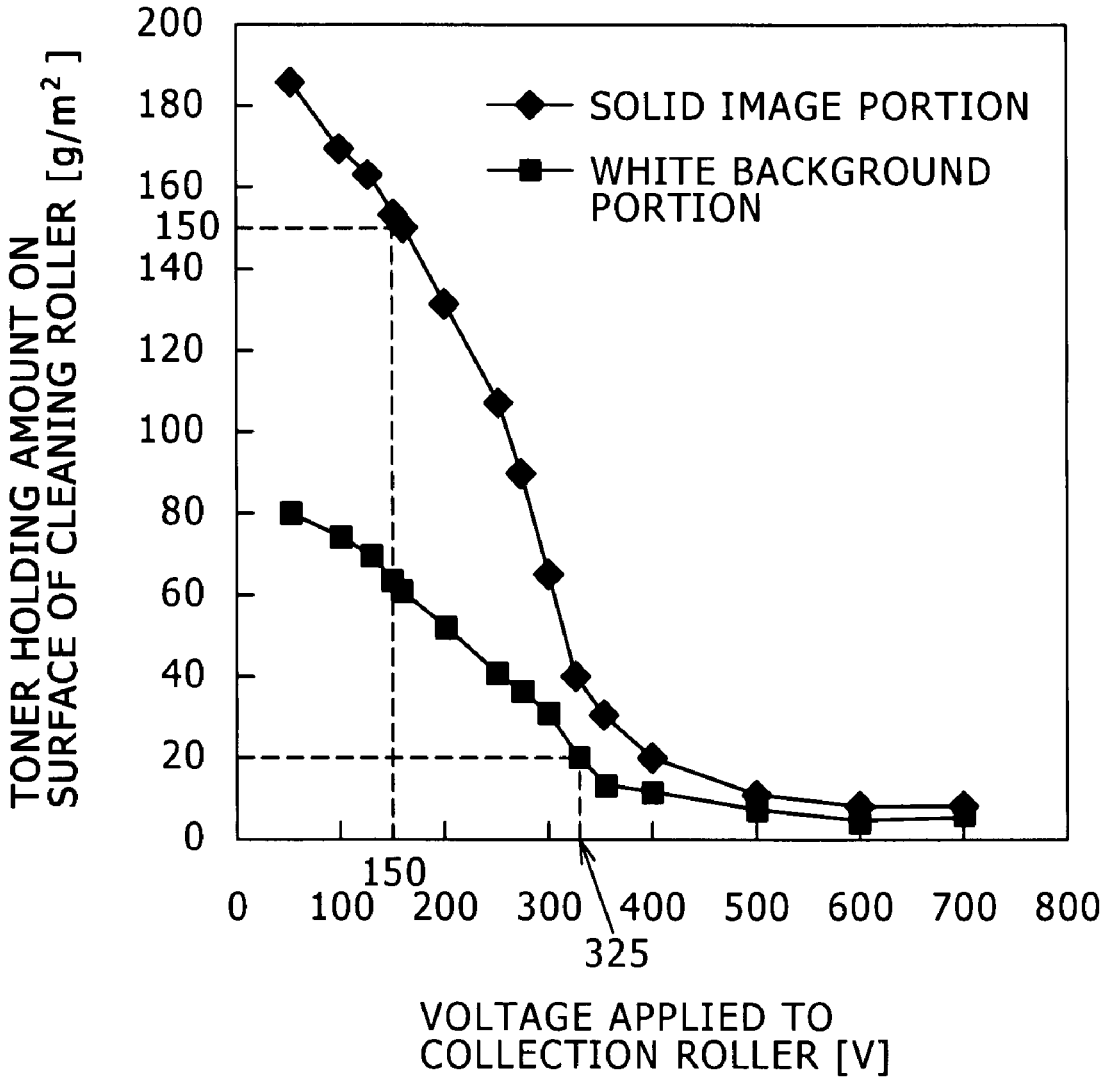
FIG. 13 is a graph showing the results of measurement of the amount of toner held on the fiber layer when the bias voltage supplied to the collection roller is changed.

FIG. 13 is a graph showing the results of measurement of the amount of toner held on the fiber layer 365*a* when the bias voltage supplied to the cleaning roller 365 is fixed to +300 V while the bias voltage supplied to the collection roller 366 is changed.

It is understood from the result shown in FIG. 13 that to set the toner holding amount to 20 g/m$^2$ or more in a white background portion, the upper limit value of the bias voltage supplied to the collection roller 366 is +325 V. Further, to set the toner holding amount to 150 g/m$^2$ or less in a solid image portion, the lower limit value of the bias voltage supplied to the collection roller 366 is +150 V. Accordingly, when the bias voltage supplied to the cleaning roller 365 is +300 V, the bias voltage supplied to the collection roller 366 may be +150 to +325 V.

To set the amount of toner held on the fiber layer 365*a* to 20 to 150 g/m$^2$, it is necessary to set the difference between the voltages for the cleaning roller 365 and the collection roller 366 (voltage for the cleaning roller 365—voltage for the collection roller 366) to −25 to 150 V. That is, including a case where negative bias voltages are applied to the cleaning roller 365 and the collection roller 366 using positive toner, it is generally necessary to set the difference between the absolute value of the voltage for the cleaning roller 365 and the absolute value of the voltage for the collection roller 366 (|voltage for the cleaning roller 365|−|voltage for the collection roller 366|) to −25 to 150 V.

Note that in the color printer 1 of this exemplary embodiment, as shown in FIG. 11, even in the case of white background chart, the toner holding amount on the fiber layer 365*a* is about 40 g/m$^2$ when printing for about 500 sheets has been completed. Accordingly, in the initial setting of the color printer 1, there is no problem in corona effluence elimination as long as the printer is used in a normal use status. However, it may be effective, on the presumption of usage requiring sufficient corona effluence elimination from the initial setting of the color printer 1 (for example, from 0 to 500 sheets), to set the toner supply mode to form a band-shaped solid image having a width of 3 cm over the entire area in the widthwise direction of the photoreceptor drum 31 in the respective image forming units 30, and supply all the toner to the cleaning roller 365 without transfer processing with the first transfer unit T1 with the first transfer roller 42 turned off. In this case, it is possible to set the toner holding amount on the fiber layer 365*a* to about 40 g/m$^2$ upon initial printing. The first transfer roller 42 is turned off and a large amount of developed toner is supplied to the cleaning roller 365. However, the arrangement may be appropriately set in correspondence with the system. For example, it may be arranged such that the first transfer roller 42 is not completely turned off but the transfer electric field is weakened thereby the amount of transfer residual toner is increased, in correspondence with the transfer efficiency or the like.

Further, the toner supply mode is not limitedly performed upon initial setting of the color printer 1 but may be performed by a predetermined number of print sheets, e.g., 500 sheets. In such case, when an image having lopsided image density is continuously printed, the toner holding amount can be uniformed over the entire area in the axial direction of the cleaning roller 365.

As timing of execution of the toner supply mode, the toner supply mode may be performed at the end of image formation cycle, or between image formation cycles.

Note that in this case, the toner supply mode is set by the controller 60, and the controller 60 functions as a toner supply mode setting unit.

In this manner, in the color printer 1 of this exemplary embodiment, a predetermined amount of toner is always held on the fiber layer 365*a* so as to eliminate the corona effluence attached to the photoreceptor drum 31.

In this arrangement, the effect of corona effluence elimination from the surface of the photoreceptor drum 31 is further enhanced while the occurrence of image formation errors such as image deletion and filming is suppressed.

Note that in the exemplary embodiment, only the cleaning roller is used, however, a brush cleaner, a roller cleaner, a blade cleaner or the like may be provided on the downstream side as in the case of Exemplary Embodiments 3 and 4.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an electrostatic latent image;

a developing unit that develops the electrostatic latent image on the image carrier into a toner image;

a transfer unit that transfers the toner image carried on the image carrier onto a transfer medium;

a cleaning unit that cleans residual toner, having not been transferred by the transfer unit, from the image carrier, the cleaning unit including a cleaning roller member provided in contact with the image carrier and supplied with a predetermined bias voltage, having a surface layer of a conductive fiber cloth provided on an elastic layer, and a conductive roller member provided in contact with the cleaning roller member and supplied with a predetermined bias voltage; and a controller that controls at least one of operations of the developing unit, the transfer unit and the cleaning unit, the controller causing the surface layer of the cleaning roller member to hold toner of a predetermined amount.

2. The image forming apparatus according to claim 1, wherein when the controller performs control to cause the surface layer to hold the toner, a difference obtained by subtracting an absolute value of the bias voltage supplied to the conductive roller member from an absolute value of the bias voltage supplied to the cleaning roller member is set to −25 V to 150 V.

3. The image forming apparatus according to claim 1, wherein the control to cause the surface layer to hold the toner is performed during image formation.

4. The image forming apparatus according to claim 1, wherein the control to cause the surface layer to hold the toner is performed when image formation is not conducted.

5. The image forming apparatus according to claim 1, the predetermined amount of toner held on the surface layer is equal to or more than 20 $g/m^2$ and less than 30 $g/m^2$, and wherein the controller causes the image carrier carrying no image to rotate.

6. The image forming apparatus according to claim 1, wherein the predetermined amount of toner held on the surface layer is equal to or more than 30 $g/m^2$ and equal to or less than 150 $g/m^2$.

7. The image forming apparatus according to claim 1, wherein the surface layer of the cleaning roller member comprises one of a cloth in which the conductive fibers are braided, a cloth in which the conductive fibers are woven, and an unwoven cloth of the conductive fiber.

8. The image forming apparatus according to claim 1, wherein the surface layer of the cleaning roller member is formed with the conductive fiber having a fiber thickness equal to or less than 2 denier.

9. The image forming apparatus according to claim 1, wherein the cleaning roller member comprises a conductive elastic layer formed under the surface layer.

10. The image forming apparatus according to claim 1, further comprising an opposite polarity toner cleaning member that eliminates toner charged with a polarity opposite to a polarity of the toner image carried on the image carrier, the opposite polarity toner cleaning member being located downstream of the cleaning roller member in a direction of rotation of the image carrier.

11. A cleaning device for cleaning residual toner on an image carrier, comprising:

a cleaning roller member, provided in contact with the image carrier, having a surface layer of a conductive fiber provided on an elastic layer supplied with a predetermined bias voltage;

a conductive roller member provided in contact with the cleaning roller member and supplied with a predetermined bias voltage; and a controller that causes the surface layer of the cleaning roller member to hold toner of a predetermined amount.

12. The cleaning device according to claim 11, wherein the surface layer of the cleaning roller member comprises one of a cloth in which the conductive fibers are braided, a cloth in which the conductive fibers are woven, and an unwoven cloth of the conductive fiber.

13. The cleaning device according to claim 11, wherein the surface layer of the cleaning roller member contains the conductive fiber having a fiber thickness equal to or less than 2 denier.

14. The cleaning device according to claim 11, wherein the cleaning roller member comprises a conductive elastic layer formed under the surface layer.

15. The cleaning device according to claim 11, further comprising an opposite polarity toner cleaning member that eliminates toner charged with a polarity opposite to a polarity of the toner image carried on the image carrier, the opposite polarity toner cleaning member being located downstream of the cleaning roller member in a direction of rotation of the image carrier.

* * * * *